United States Patent [19]

Finkbeiner et al.

[11] Patent Number: 4,637,552

[45] Date of Patent: Jan. 20, 1987

[54] WATER JET AERATION FOR SANITARY FITTINGS AND THE LIKE

[75] Inventors: Werner Finkbeiner; Franz Schorn, both of Schiltach, Fed. Rep. of Germany

[73] Assignee: Hans Grohe GmbH & Co. KG, Fed. Rep. of Germany

[21] Appl. No.: 699,659

[22] Filed: Feb. 8, 1985

[30] Foreign Application Priority Data

Feb. 10, 1984 [DE] Fed. Rep. of Germany ..... 3404662

[51] Int. Cl.[4] ..... E03C 1/08; B05B 7/06; B05B 1/14

[52] U.S. Cl. ..... 239/428.5; 239/432; 239/553.3; 239/553.5; 261/DIG. 22

[58] Field of Search ..... 239/428.5, 432, 553.3, 239/553.5; 261/DIG. 22

[56] References Cited

U.S. PATENT DOCUMENTS

| | | | |
|---|---|---|---|
| 2,365,554 | 8/1951 | Goodrie | 261/116 |
| 2,510,396 | 6/1953 | Goodrie | 261/111 |
| 2,670,942 | 3/1954 | Aghnides | 261/116 |
| 2,950,063 | 12/1956 | Ripley | 239/553.5 X |
| 2,998,933 | 9/1961 | Aghnides | 239/428.5 |
| 3,104,819 | 9/1963 | Aghnides | 239/106 |
| 3,182,916 | 5/1965 | Schulz | 239/468 |
| 3,799,450 | 3/1974 | Braukman | 239/428 |
| 4,082,225 | 4/1978 | Haynes | 239/428 |
| 4,379,097 | 4/1983 | Leggett | 261/78 |
| 4,474,329 | 10/1984 | Finkbeiner | 239/428.5 |

FOREIGN PATENT DOCUMENTS

| | | | |
|---|---|---|---|
| 0060540 | 3/1982 | European Pat. Off. . | |
| 820550 | 11/1951 | Fed. Rep. of Germany . | |
| 1214618 | 9/1957 | Fed. Rep. of Germany . | |
| 1076592 | 2/1960 | Fed. Rep. of Germany . | |
| 1081838 | 5/1960 | Fed. Rep. of Germany | 239/428.5 |
| 1818699 | 9/1960 | Fed. Rep. of Germany . | |
| 2821195 | 5/1978 | Fed. Rep. of Germany . | |
| 2919734 | 5/1979 | Fed. Rep. of Germany . | |
| 364225 | 12/1957 | Switzerland . | |

*Primary Examiner*—Andres Kashnikow
*Assistant Examiner*—Patrick N. Burkhart
*Attorney, Agent, or Firm*—Steele, Gould & Fried

[57] ABSTRACT

The invention relates to a water jet aerator which, in place of conventional metal screens, has at least two separate staircase-like obstacles, which project laterally into the paths of the individual jets and split up the jets, and mix them with air. Several such obstacles are arranged in the immediate proximity of one another, successively in the direction of flow, so that a cohesive, well-ventilated jet is obtained. The configuration of the jet cross-section can vary as a function of the arrangement of the facing walls defining the flow path in the area of the obstacles.

31 Claims, 7 Drawing Figures

WATER JET AERATION FOR SANITARY FITTINGS AND THE LIKE

BACKGROUND OF THE INVENTION

1. Field of the Invention

The invention relates to a water jet aerator for sanitary fittings and the like with at least one device for producing individual jets, at least one chamber positioned below it for the air supply and at least one device for splitting up and mixing the individual jets with air.

2. Prior Art

Aerators for sanitary fittings are widely used nowadays, because an aerated or ventilated water jet does not splash and permits a quiet flow of water. For many uses, such as washing the hands, the quantity of water can be reduced without to any disadvantage effects in the ventilated jet.

Known devices for producing the individual jets are constructed in a substantially standardized manner. One or more superimposed perforated plates are provided successively in the direction of flow, the holes normally being displaced transversely relative to one another. Below the last perforated plate there is usually a free space, with passages for air supply from the outside, so that air can be sucked into the free space.

In known jet aerators or ventilators, there are considerable differences in the way in which the individual jets are split up. Thus, in many conventional jet aerators, there is a screen or sieve arrangement of several superimposed screens or sieves, which split up the jet and bring about the mixing with air. However, such jet ventilators have a tendency to clog through liming. German Auslegesschrift No. 2,114,618 discloses a jet ventilator, in which the individual jets strike against the sloping surfaces of a mushroom-type baffle plate and are thereby split up and mixed with the air. However, the mushroom-shaped member takes up a considerable portion of the passage cross-section, so that there is a considerable flow restriction and an unfavorable cross-sectional ratio. This is even more apparent in the case of the jet ventilator according to German Offenlegungsschrift No. 2,821,195, in which the individual jets are directed against baffle plates, which reflect the jets backwards against the flow. European Patent application No. 82102033, which corresponds to U.S. Pat. No. 4,474,329—Finkbeiner, discloses a shower head which makes it possible to form a plurality of individual ventilated shower jets. For this purpose, passages with relatively small axial obstruction are provided, inner walls of the passages having obstacles for separating and splitting up the individual jets. The ventilated jets passing out of these passages have a relatively small cross-section. They are suitable for a shower head, but are less suitable for the outlet of a mixing valve, a bath outlet or the like.

SUMMARY OF THE INVENTION

An object of the present invention is to provide a water jet ventilator particularly for taps and flows into baths, which forms a uniform aerated solid jet, without any risk of liming, such as occurs with water jet ventilators with screens.

According to the invention, at least two cooperating devices split up the individual jets. The two devices have cooperating walls which catch the individual jets and at least one has lateral obstacles projecting into the path of the individual jets. In at least one device for splitting up the individual jets, there are substantially only two facing, cooperating walls and at least two individual devices for splitting up the individual jets are so close together that the ventilated jets pass out as a joint ventilated jet.

It has been found that it is possible to produce ventilated jets with a sufficiently large cross-section for a normal water tap or the flow into a bath in that, in place of passages with a substantially circular cross-section as described in U.S. Pat. No. 4,474,329, passages or the like are used which are only bounded on two sides. As a result, there is only a minimum deflection of the individual jets, as in the case of U.S. Pat. No. 4,474,329, which is hereby incorporated by reference. This means that it is sufficient to place lateral obstacles in the path of the individual jets or part thereof and the lateral extension of the obstacles is of the order of magnitude of the diameter of the individual jets. Additional cross-sectional constrictions are not necessary. There are no jet splitting screens. It is in fact an advantage of the invention that the water jet ventilator is free from such screens.

In fact, the passage or the further path of the jets after they are split can remain substantially cross-sectionally constant. It is consequently possible to obtain linear or lamellar (parallel sheet) jets which, in cross-section, can be of random length in their longitudinal extension, whereas the thickness or width is determined by the spacing of the cooperating walls and can be adjusted to an optimum. By closely juxtaposing such strips, it is possible to obtain solid jets with a large total cross-section having a good jet force, because the individual jets making up the total are only slightly deflected from their original direction as they are split up. The strips are preferably annular and are concentric to one another.

Generally, several annular devices for splitting up and ventilating the individual jets are arranged concentrically, the innermost device also being annularly arrangeable around a core, or a free central passage may be provided in a core. Preferably, a common device for producing individual jets and an associated air chamber are associated with several or all the devices for splitting up and ventilating the individual jets.

The cooperating walls of the devices for splitting and ventilating the individual jets preferably continue along the flow direction to the outlet of the ventilated jets, so that they have a calming effect on the latter. It is also possible to provide partitions in the jet direction which are substantially perpendicular to said walls, the partitions preferably being located at the jet ventilator outlet.

The lateral obstacles for splitting up the individual jets are particularly appropriately stair-like steps and, with respect to the flow direction of the individual jets, the individual steps project increasingly further into the flow passage area of the devices for splitting up the individual jets. Preferably, the facing wall is correspondingly set back in steps, so that the cross-sectional area defined between the walls is not significantly constricted. Generally, such a staircase-like obstacle has 2 to 8 and preferably 2 to 4 steps.

It is possible to vary within wide limits the number of individual jets which are at least partly directed onto the staircase-like obstacles. In the case on concentrically arranged staircase-like obstacles, the outlets are also preferably located on concentric rings. One or more rows or rings of openings for forming individual jets can be directed onto a device for splitting and ventilating said jets. However, it is also possible for one row or ring with openings for forming individual jets to be directed onto two devices for splitting up said jets, particularly if said devices are constructed as a two-sided staircase with a common top step. It is generally sufficient in the case of individual jet splitting up devices for one of the cooperating walls to have obstacles. The facing wall then holds together the split jet, then mixed with the air. However, such obstacles can also be provided on the two facing sides of the walls and then there is preferably a relative displacement of the obstacles by height. The walls on both sides can cooperate with further walls and to this end can be provided on either side with obstacles.

In the case of concentrically arranged jet splitting up devices, preferably at least the inner wall is provided with obstacles. If the obstacles are constructed in double-sided manner and particularly in cross-section in the form of a stepped pyramid, then the obstacle part directed towards the center preferably also has fewer steps or steps that are less wide or deep than those directed outwardly. Thus, the passage between the facing obstacles or walls can be kept as wide as possible, which is also aided by the fact that the facing obstacles or walls are at least partly axially displaced relative to one another.

The smallest spacing between two facing walls in the vicinity of the obstacles, i.e. the minimum spacing to be traversed by the jets after leaving their outlets in the perforated plate, is consequently advantageously in the range of 0.5 to 1.5 and preferably 0.7 to 1.2 times the further spacing of the partitions. Downstream of the splitting up device, the further course of the ventilated jets between preferably parallel walls takes place with substantially no cross-section modification up to the outlet surface, so that a good beam pattern is obtained. As the partitions between the individual lamellar or annular outlets for the ventilated jets are kept thin and preferably taper-like blades towards the outlet, there is a combination of these jets without prejudicing the jet pattern. Thus, a much more uniform and better ventilated jet is obtained than in the case where an attempt is made to extend a small cross-section ventilated jet to such a larger cross-section.

BRIEF DESCRIPTION OF THE DRAWINGS

The invention is described in greater detail hereinafter relative to non-limitative embodiments and with reference to the attached drawings, wherein.

DETAILED DESCRIPTION OF THE PREFERRED EMBODIMENTS

Figure 1:
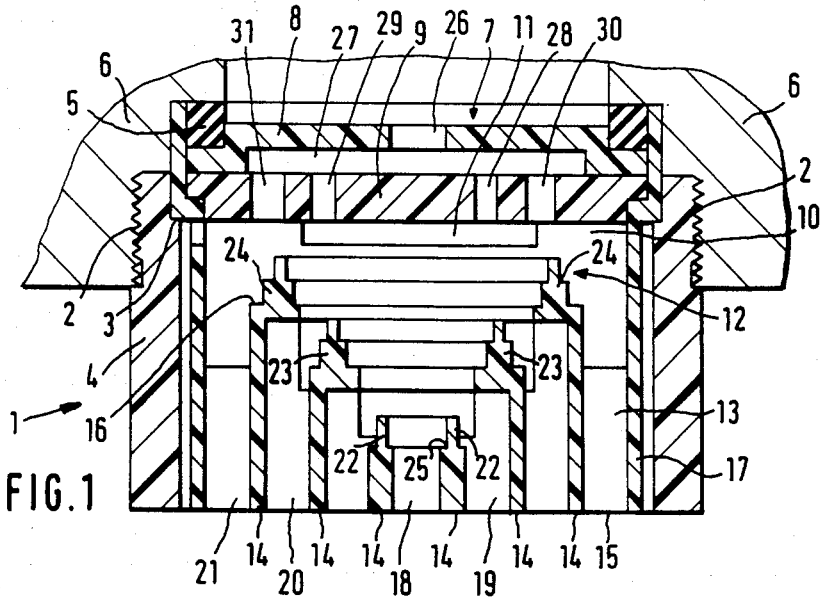
FIG. 1 is a section view taken through an embodiment of the invention shown fitted in place.

In the case of the embodiments shown in FIGS. 1 to 7, there is in each case a substantially cylindrical water jet aerator or ventilator 1, which is fixed to the outlet of a tap 6 or the like in conventional manner by means of a sleeve 4 having an external thread 2 and a stop shoulder 3. A sealing washer 5 is interposed.

Along the flow direction, ventilator 1 substantially comprises four functional units. A device 7 for producing individual water jets is formed by two perforated plates 8, 9 with holes laterally displaced relative to one another. An air chamber 10 is defined below device 7 and is supplied with air by lateral openings 11. A plurality of concentric staircase-like devices 12 for splitting up the individual jets accompanied by simultaneous mixing the air are connected concentric guide channels 13, which serve to calm and stabilize the water/air mixture. The guide channels have common partitions 14, as well as additional radial partitions 15 which, at least on the outlet side, are kept so thin that on leaving ventilator 1, the air/water flows from the ventilated jets combine to a single joint ventilated water jet. Partitions 14, 15 extend downwards to the outlet surface of the ventilated jet, the concentric partitions 14 constituting the downward extension of the bottom step 16 of each of the staircase-like obstacles 12. The radial partitions 15 only commence below obstacles 12 and taper downwards in like a blade edge. The jet ventilator 1 has an outer casing 17 with a conventional external diameter and with a step-like extension in its upper area, for engaging on shoulder 3 of fixing sleeve 4.

Figure 2:
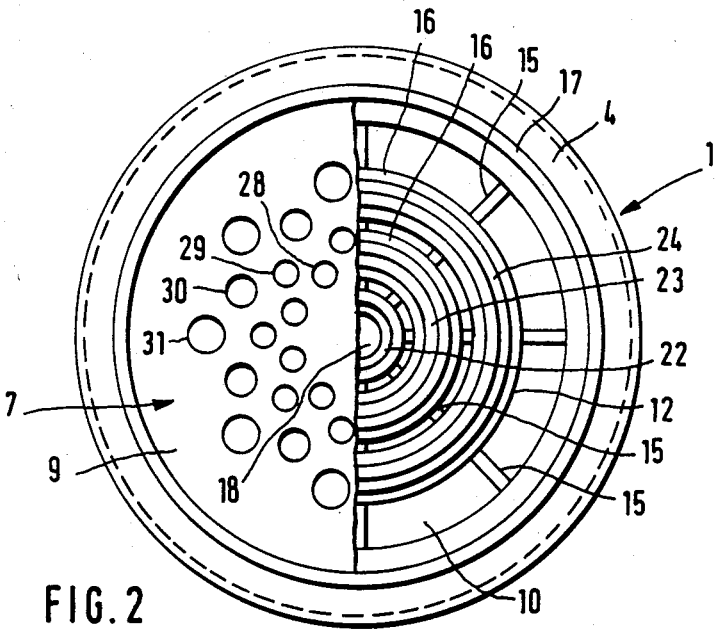
FIG. 2 is a plan view of the embodiment according to FIG. 1 in the unfitted state, the device for producing the individual jets being shown partly cut away.

In the embodiment according to FIGS. 1 and 2, there are four concentrically arranged cylindrical sleeves 14, 17, which terminate in a common outlet plane for the ventilated jet and define four passages 18, 19, 20, 21, the central passage 18 being cylindrical while the passages 19 to 21 arranged around it, are annular and are interrupted by 8 web-like, radial partitions 15. The outermost sleeve forms the outer casing 17 of the jet ventilator 1.

The sleeves representing the concentric partitions 14 increase in length from the inside to the outside and carry annular attachments 22, 23, 24 at their upstream ends. These annular attachments are widened in steps along the direction of flow such that their cross-sections resemble stepped pyramids, i.e. defining oppositely-oriented staircase-like shapes on either side. The inner attachment 22 of the inner partition 14 around passage 18 only has a two-sided step 25, which is narrow and high and simply reduces the thickness of the partition 14 at the upper edge. However, attachments 23 and 24 of the next outward partitions 14, which outwardly define passages 19, 20 and inwardly define passages 20, 21, have on either side two-step staircases, whereof the step depth is smaller than the step height. In addition, on the inside of attachment 24, the step depth is also smaller than on its outside. As described, the step "height" is its length in the axial flow direction; and step "depth" is its lateral width.

Attachments 23, 24 rest asymmetrically on the associated partitions 14, which constitute a downward extension of the lowermost outer step 16, whereas the other inwardly directed part of the attachments 23, 24 is self-supporting in the manner of an undercut. This leads to a preferably outwardly diverging split up of the individual jets. Furthermore, the heights of the attachments 22 to 24 are displaced with respect to one another in such a way that the lower edge of the lowermost step of an outer staircase is at least as high as the upper edge of the uppermost step of the next inner staircase. As a result of this axial funnel-shaped displacement, the staircase-like attachments 22 to 24, which bring about the splitting up of the individual jets, can be arranged with short radial spacings relative to one another and in projection only correspond roughly to the width of a single step, without thereby impairing the flow cross-section for the air/water mixture between the attachments. This permits a tight arrangement of the jet splitting obstacles 12 with respect to the cross-section of the jet ventilator, which leads to the formation of a well ventilated solid jet over the entire cross-section of the ventilator.

The upper perforated plate 8 has a large central hole 26, flow from which is applied to the lower perforated plate 9. By means of a gap 27 between the two plates 8, 9, water from hole 26 spreads uniformly over the lower plate 9. The latter has four concentric annular rows of holes 28, 29, 30, 31, each row having ten holes. The holes increase in size from the inner row 28 to the outer row 31 and, the hole spacing alternates from row to row so that each step of attachments 23, 24 is struck by individual jets. Corresponding to the larger passage cross-section to passages 20 and 21, more water is supplied to the outer attachment 24 than in the case of passages 18, 19. In addition, in this embodiment, the outer casing 17 has no staircase-like obstacles, so that the passage 21 is only supplied with water/air mixture by one staircase-like obstacle, namely the outside of the staircase-like attachment 24. This is compensated by the larger holes in the outer row 31. Moreover, the rows of holes 28 to 31 in perforated plate 19 are arranged in such a way that the inner staircase-like attachment 22 surrounding the cylindrical passage 18 and inwardly defining the first annular passage 19, instead of being directly struck by the individual jets leaving the holes in rows 28 to 31, is struck by jets which are mainly deflected by the inside of the next outer staircase-like obstacle 23 and are further split up on either side of obstacle 22.

The water jet ventilator according to the invention can be simply made completely from plastic. The ventilator body aside from the two perforated plates 8, 9 and which has the air access openings 11, jet splitting devices 12 and guide channels 13, can be constructed in a simple manner in one piece by injection molding, without requiring complicated molds. In addition, the construction of the jet ventilator according to the invention is capable of numerous variations without modifying its essential operation. Thus, even more annular passages with associated jet splitting devices can be provided, while increasing the total cross-section of the ventilated jet. In order to permit a short overall construction height, additional jet splitting obstacles can be provided starting again at a low level and progressively rising outwardly. It is also possible to use other than a circular shape, so that the annular passages have an oval or other cross-section. In addition, the center of the ventilator can be filled or can have an independent air supply, so that an annular ventilated jet is obtained. A star-shaped or radial arrangement of the obstacles is also possible.

Figure 3:
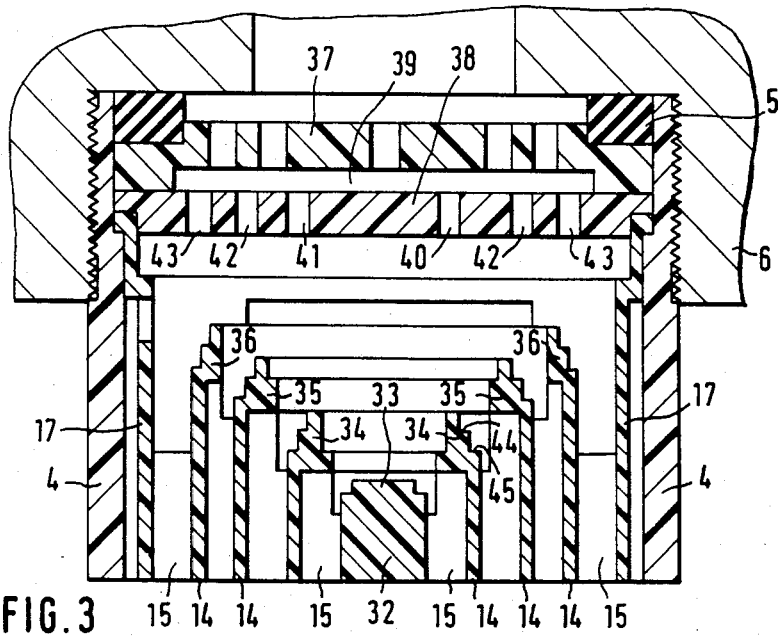
FIG. 3 is a section through another embodiment of the invention as fitted.
Figure 4:
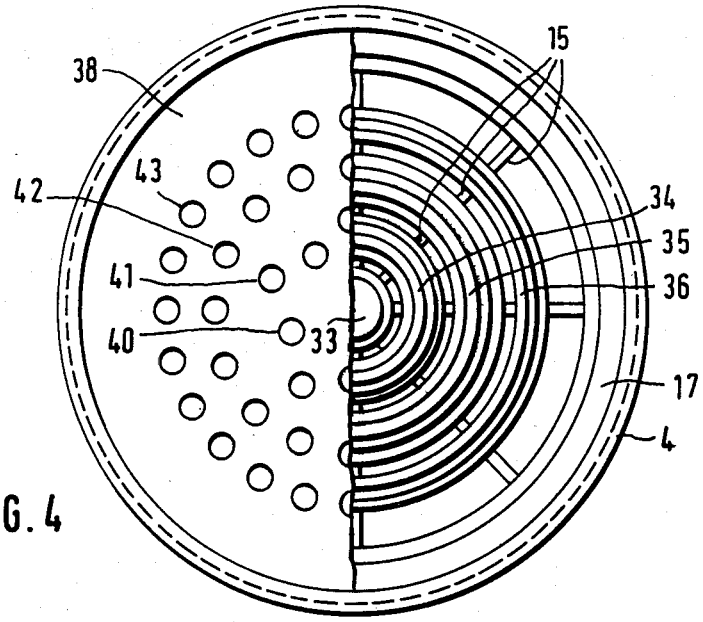
FIG. 4 is a plan view of the embodiment according to FIG. 3 in the unfitted state, the device for producing the individual jets being shown partly cut away.

In the embodiment according to FIGS. 3 and 4, the same reference numerals as in the embodiment according to FIGS. 1 and 2 are used for the same parts. Therefore, these parts will not be described again. In the embodiment according to FIGS. 3 and 4, there are four guide channels, defined between the partitions and walls, and guide channels being annular. In place of the cylindrical passage 18 of the embodiment according to FIG. 1, the center 32 is in this case solid and has a staircase-like face 33 with an annular step. Several steps could also be provided. However, the diameter of the solid center is still sufficiently small for the annular ventilated jets passing out of the channels 13 to combine to give a common solid jet, particularly as center 32 is not ventilated. The next outward staircase-like parts 34, 35, 36 on the facing ends of the concentric partitions 14 have fewer steps on their inside than on their outside. This makes it possible to keep the height difference between the staircase parts smaller, so that their step structures partly overlap. It is also possible to move the staircase parts radially close together and consequently to reduce the channel width, without reducing the flow cross-section between the attachments. This is illustrated by the relationship between attachments 35 and 36, the latter not being stepped on the inside.

For producing the individual jets in this embodiment, there are two superimposed perforated plates 37, 38 with gap 39 between them. Once again the holes between the two plates are at least partly laterally displaced relative to one another, which is known per se. There are also once again four rows of holes 40 to 43, but in this case the diameter of the holes is the same, whereas the number of holes per row increases from the inside to the outside. The holes of the outer rows 41 to 43 are not spaced alternately with the next inner rows and are in each case the holes are directed towards the outer staircase-like steps of attachments 34, 35 and 36. However, the innermost row of holes 40 is arranged to alternate spacing with row 41. As can be gathered from the right-hand half of FIG. 3 (like FIG. 1, the section of FIG. 3 is spaced slightly from the diametric plane) a jet directly strikes the uppermost part of step 44 and the next inward lower step 45 of the staircase-like attachment part 44.

In the embodiments according to FIGS. 1 to 4, as a result of the more outwardly pronounced staircase-like steps of the splitting devices 12 or the staircase-like attachments, there is a tendency for the individual jets passing out of the lower perforated plate 9 or 38 to be deflected outwards more than inwards. This makes it possible to utilize to the maximum the outlet cross-section of the jet ventilator for the air/water mixture, so that the complete inlet cross-section can be kept correspondingly large for the individual water jets. Conversely, it may be desired in certain cases to keep the outflow cross-section of the ventilated jet relatively small, without modifying the assembly dimensions of the ventilating means and the external appearance thereof.

Figure 5:
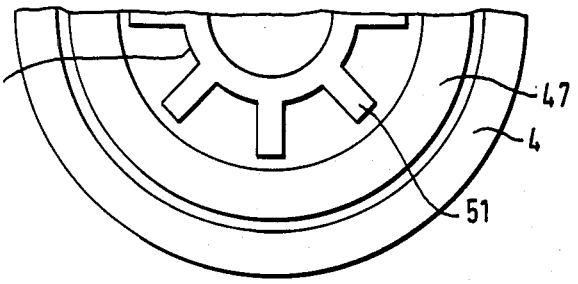
FIG. 5 is a partial bottom view of a further embodiment.
Figure 6:
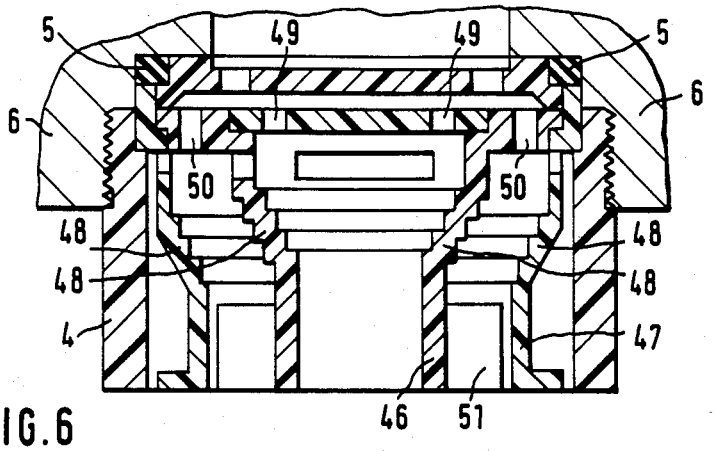
FIG. 6 is a section through the embodiment according to FIG. 5 as fitted.
Figure 7:
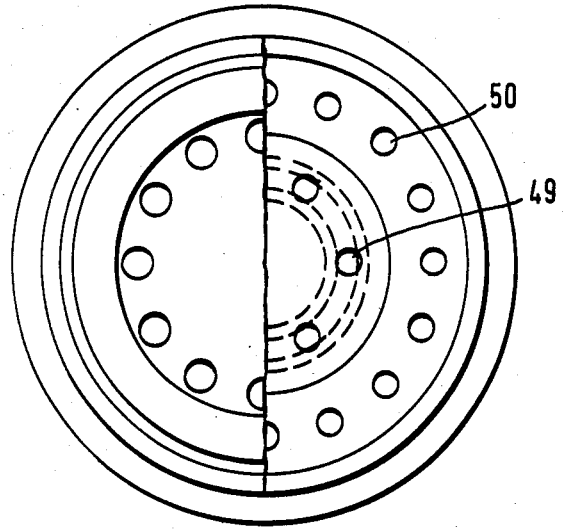
FIG. 7 is a plan view of the embodiment according to FIG. 5, part of the device for producing the individual jets being shown cut away.

This is the case with the embodiment according to FIGS. 5 to 7. As can be gathered from FIG. 6, there are two concentric sleeves 46, 47, which are substantially cylindrical in the lower region and are widened in funnel-like manner in the upper region. In the upper region, the sleeves have a staircase-like step system 48 with in each case four individual steps on the inside. The inner sleeve 46 is even stepped on the outside of the funnel-shaped region. The funnel-shaped regions of the two sleeves 46,47 with the steps 48 are so displaced in axial height, that the spacing between sleeves 46, 47 remains substantially constant along the flow direction, even in the bevelled region. This is due to the fact that the funnel-shaped region of the outer sleeve 47 is lower than that of the inner sleeve 46. The conditions are in fact the opposite to those of the embodiments according to FIGS. 1 to 4 where the outermost elements have higher splitting structures. For forming the individual jets, there are two rows of holes 49, 50, which are directed precisely onto the staircase-like steps 48 of the two sleeves 46, 47. It is obvious that the two sleeves with their associated rows of holes could be replaced by several sleeves and several rows of holes arranged in a corresponding manner.

In place of the radial partitions 15, as provided in the annular channels of the embodiments according to FIGS. 1 to 4, in the embodiment of FIGS. 5 to 7 there are merely radial separating members 51, which point outwards from the cylindrical part of inner sleeve 46. The separating members substantially fulfill the same function as the annular channel walls, but permit a construction of the jet ventilator from several separate funnel-shaped components.

In the case of the water jet ventilator according to the invention, the outlet surface for the common ventilated water jet can also be curved downwards. In addition, the channels for the still separate ventilated jets can also have a diverging direction. Simple production by injection molding is possible and in particular the number of components can be kept small, because all can be produced in one piece.

We claim:

1. A water jet ventilator for sanitary fittings and the like, comprising:

at least one device for producing a plurality of individual water jets along a direction of flow;

a housing defining at least one chamber arranged downstream of said device for producing individual jets, the housing having an opening for air access to the chambers;

at least one device for splitting and mixing the individual jets with air, having at least two separate devices for splitting up the individual jets, each having two cooperating walls defining passages which catch the individual jets, at least one of the two cooperating walls having lateral obstacles defining a staircase structure projecting into a path of the individual jets, at least one of said separate devices for splitting the individual jets having two facing cooperating walls, the cooperating walls continuing downstream of the devices and defining unobstructed channels, the cooperating walls of the separate devices having obstacles directed towards one another, the separate devices being displaced from one another in the direction of flow, and the separate devices for splitting the individual jets being so closely juxtaposed that the ventilated jets flow out as a joint ventilated jet.

2. A water jet ventilator according to claim 1, wherein the two cooperating walls of each of the separate devices for splitting the individual jets define a passage having a slot-like cross-section.

3. A water jet ventilator according to claim 2, wherein the two cooperating walls of each of the separate devices for splitting the individual jets define an annular slot.

4. A water jet ventilator according to claims 1 or 3, wherein the separate devices for splitting the individual jets are arranged concentrically.

5. A water jet ventilator according to claim 1, wherein the passages are defined by common partitions.

6. A water jet ventilator according to claim 1, wherein a common device for producing the individual jets is associated with at least several of the devices for splitting the individual jets.

7. A water jet ventilator according to claim 1, wherein the obstacles project from the walls at least partly into the paths of the individual jets and define staircase-like structures.

8. A water jet ventilator according to claim 1, wherein the openings of the devices for producing the individual jets are at least partly directed towards an uppermost step of the staircase structures in the flow direction.

9. A water jet ventilator according to claim 4, wherein at least an inner wall of said two cooperating walls defining passages of the concentrically arranged separate devices for splitting the individual jets has laterally outwardly directed obstacles.

10. A water jet ventilator according to claim 7, wherein the obstacles projecting from one of the cooperating walls to a splitting device directed laterally towards one side, and the obstacles projecting laterally to a splitting device towards an other side are arranged at an equal height in the flow direction.

11. A water jet ventilator according to claim 1, wherein the cooperating walls are arranged eccentrically on the obstacles.

12. A water jet ventilator according to claim 10, wherein the obstacles projecting from the one side and the other side of the wall define a stepped pyramid in their cross-section.

13. A water jet ventilator according to claim 12, wherein the cross-sectionally stepped pyramidal obstacles have a differing lateral width to opposite sides.

14. A water jet ventilator according to claim 1, wherein a narrowest point between two facing walls in a vicinity of the obstacles corresponds to 0.5 to 1.5 times a distance between the two cooperating walls.

15. A water jet ventilator according to claim 1, wherein between the cooperating walls are arranged vertical intermediate webs substantially perpendicular to said cooperating walls.

16. A water jet ventilator according to claim 1, wherein the ventilator is completely made from plastic.

17. A water jet ventilator according to claim 1, wherein the separate devices for splitting the individual jets are made in a single piece from plastic.

18. A water jet ventilator according to claim 1, wherein the ventilator has threads for direct fixing of the ventilators to water outlets of taps.

19. A water jet ventilator according to claim 1, wherein the cooperating walls of the devices for splitting the individual jets are continued downstream of the devices in unobstructed channels in the form of concentric, cylindrical walls.

20. A water jet ventilator according to claim 6, wherein a common device for producing the individual jets is associated with all the separate devices for splitting the individual jets.

21. A water jet ventilator according to claim 7, wherein the obstacles projecting from the walls in staircase-like manner project increasingly further across the flow direction of the individual jets progressing in a direction of flow.

22. A water jet ventilator according to claim 8, wherein the openings of the separate devices for producing the individual jets are completely directed towards an uppermost step of the staircase-like obstacles.

23. A water jet ventilator according to claim 12, wherein the walls downstream of the obstacles constitute a downward extension of a bottom outer step of the stepped pyramid.

24. A water jet ventilator according to claim 12, wherein obstacles extending laterally from one side of one of the two cooperating walls defining a pyramidal cross-section are smaller in at least one of number of pyramid steps and width of pyramid steps, than on an opposite side.

25. A water jet ventilator according to claim 24, wherein the obstacles are smaller toward an inside of the wall and larger toward an outside of the wall.

26. A water jet ventilator according to claim 15, wherein the intermediate webs extend from said cooperating walls to an outlet of the ventilated jets, and are tapered to narrow towards said outlet.

27. A water jet ventilator according to claim 16, wherein the ventilator is made by injection molding.

28. A water jet ventilator according to claim 17, wherein the separate devices for splitting up the individual jets, and the walls defining passages connected thereto are made in separate single pieces of plastic.

29. A water jet ventilator according to claim 17, wherein the single pieces defining said passages have receptacles for the device for forming the individual jets.

30. A water jet ventilator for sanitary fittings and the like, comprising:

at least one device for producing a plurality of individual water jets along a direction of flow;

a housing defining at least one chamber arranged downstream of said device for producing individual jets, the housing having an opening for air access to the chambers;

at least one device for splitting and mixing the individual jets with air, having at least two separate devices for splitting up the individual jets, each having cooperating walls defining passages which catch the individual jets, at least one of the cooperating walls having lateral obstacles defining a staircase structure projecting into a path of the individual jets, the cooperating walls continuing downstream of the devices and defining unobstructed channels, the separate devices being displaced from one another in the direction of flow, and the separate devices being so closely juxtaposed that the ventilated jets flow out as a joint ventilated jet.

31. A water jet ventilator according to claim 30, wherein the separate devices for breaking up the individual jets have concentric sleeves with a substantially cylindrical shape in a downstream region of the ventator and a funnel-like shape in an upstream region of the ventilator, the concentric sleeves having a staircase-like step configuration at the upstream, funnel-like shape, and the sleeves of the separate devices being displaced from one another in the direction of flow.

* * * * *